US005983762A

United States Patent [19]

Chen et al.

[11] Patent Number: 5,983,762

[45] Date of Patent: Nov. 16, 1999

[54] PUNCH CATCH DEVICE

[76] Inventors: Jung-Huang Chen; Yu-Chun Chiang, both of 56, Min Sheng Street, Feng-Yuan City, Taichung 42041, Taiwan

[21] Appl. No.: 09/063,501

[22] Filed: Apr. 18, 1998

[30] Foreign Application Priority Data

Apr. 24, 1997 [CN] China ..... 97 2 14460.9

[51] Int. Cl.[6] ..... B26D 7/18

[52] U.S. Cl. ..... 83/82; 83/167; 83/157; 83/165

[58] Field of Search ..... 83/167, 157, 81, 83/82, 125, 136, 165, 563, 684, 685, 104, 112; 72/427, 420, 426; 100/218

[56] References Cited

U.S. PATENT DOCUMENTS 3,148,571 9/1964 Wallis ..... 83/157 X
3,653,293 4/1972 Wallis ..... 83/82
3,756,107 9/1973 Pax et al. ..... 83/157 X
4,068,519 1/1978 Baringer ..... 83/81 X

*Primary Examiner*—Rinaldi I. Rada
*Assistant Examiner*—Boyer Ashley

[57] ABSTRACT

A punch catch device for use with a punch machine comprising a mold. The mold of the punch machine has a mechanism to press products and waste materials downwardly until the products and waste materials are released from the mold. The punch catch device is movably positioned on the frame of the punch machine to move during the movement of the punching operation such that the products and waste materials are received in a catch basin of the punch catch device. The punch catch device includes an adjustment mechanism for adjusting the height and angle of the catch basin.

5 Claims, 5 Drawing Sheets

PUNCH CATCH DEVICE

BACKGROUND OF THE INVENTION

This invention relates to a punch catch device, and more particularly, this invention relates to a punch machine which has a catch device to receive products and waste materials safely.

A traditional punch machine comprises a mold. The mold has a mechanism to press products and waste materials downward until the products and waste materials are released from the mold. The products and waste materials are blown out of the traditional punch machine with a strong wind. However, the products and waste materials may fall down on the traditional punch machine if the wind is not strong enough.

SUMMARY OF THE INVENTION

An object of the invention is to provide a punch machine which has a catch device to receive products and waste materials safely.

Accordingly, a punch catch device comprises a hollow main body, an adjustment block disposed in the hollow main body, a center hole formed on the adjustment block, a frame having a post inserted in the center hole, a pinion and a gear disposed in the frame coaxially, a first rack inserted through the frame to engage with the pinion, a hollow plate disposed on the first rack, a screw rod inserted through the hollow plate, a spring enclosing the screw rod, a push bar disposed on the hollow plate, a guide rail having a cover disposed on the frame and a hollow interior receiving a second rack, the second rack engaging with the gear, and a plurality of fasteners fastening a catch basin on the second rack. The cover has a round hole. A bearing is inserted in the round hole.

DETAILED DESCRIPTION OF THE INVENTION

Figure 1:
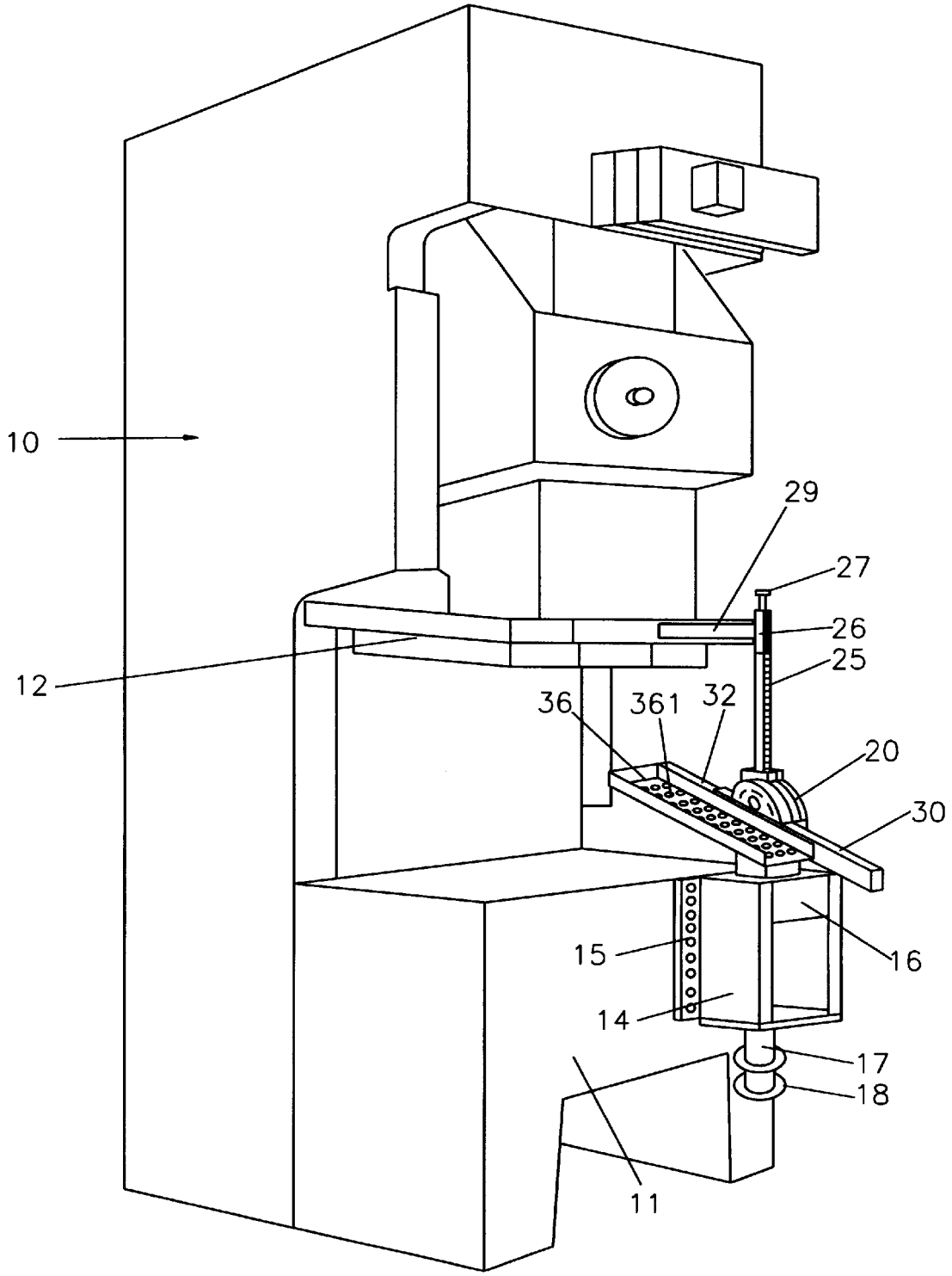
FIG. 1 is a perspective assembly view of a punch machine of a preferred embodiment in accordance with this invention.
Figure 2:
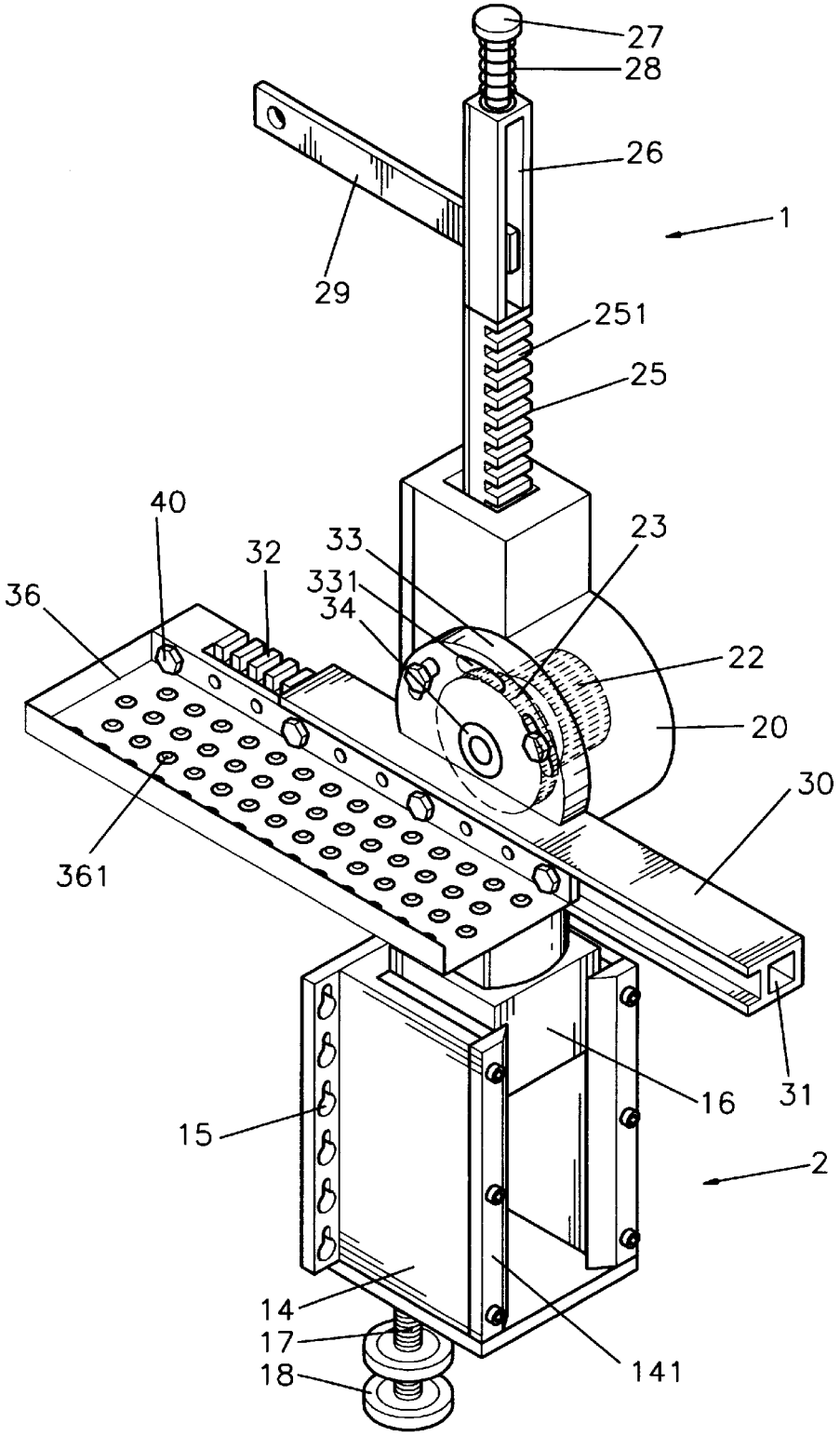
FIG. 2 is a perspective assembly view of a punch catch device of a preferred embodiment in accordance with this invention.
Figure 3:
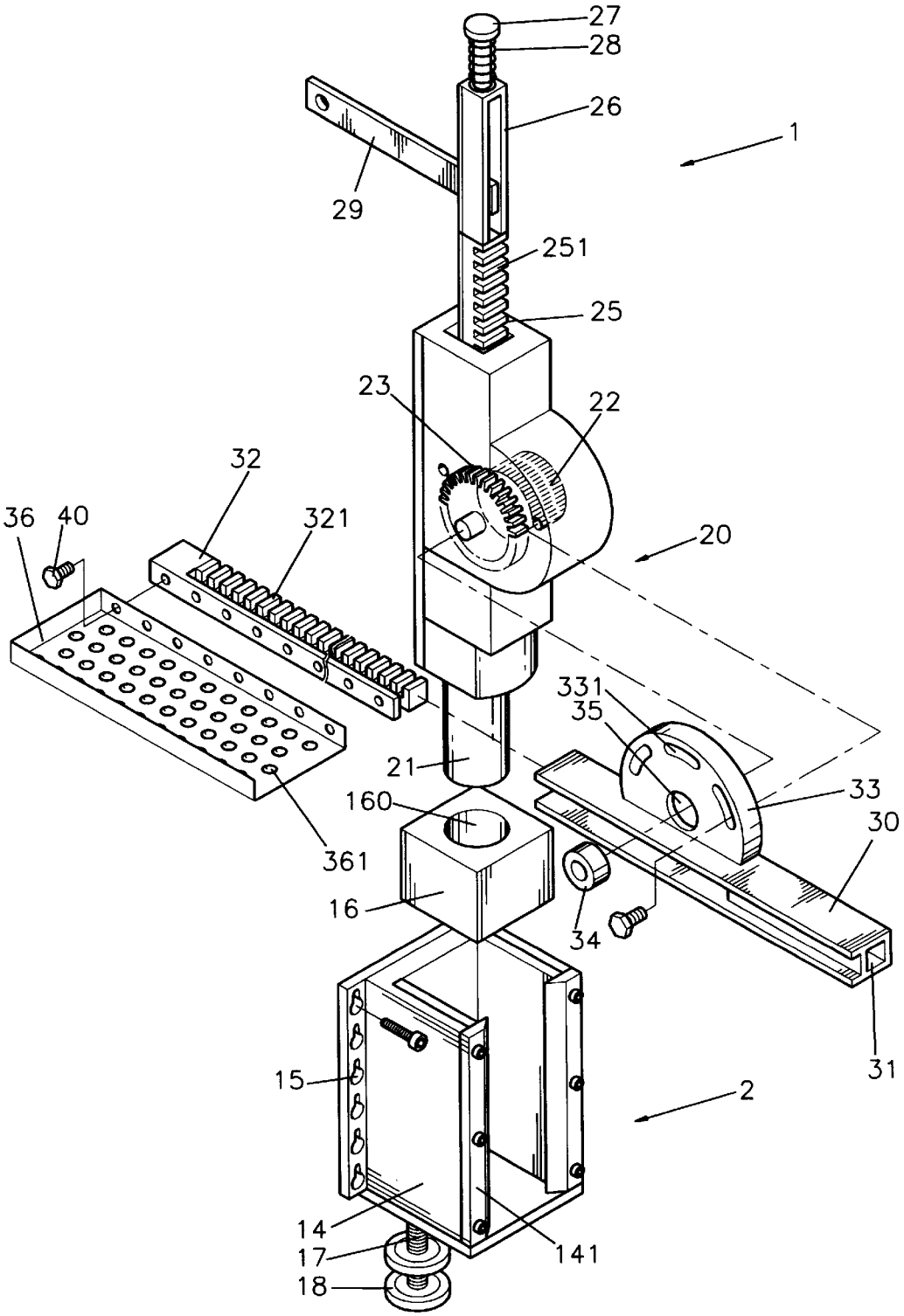
FIG. 3 is a perspective exploded view of a punch catch device of a preferred embodiment in accordance with this invention.

Referring to FIGS. 1 to 3, a punch machine 10 comprises a mold device 12 and a platform 11. A punch catch device 1 is disposed on the platform 11. The punch catch device 1 comprises a hollow main body 2, an adjustment block 16 disposed in the hollow main body 2, a center hole 160 formed on the adjustment block 16, a frame 20 having a post 21 inserted in the center hole 160, a pinion 22 and a gear 23 disposed in the frame 20 coaxially, a first rack 25 inserted through the frame 20 to engage with the pinion 22, a hollow plate 26 disposed on the first rack 25, a screw rod 27 inserted through the hollow plate 26, a spring 28 enclosing the screw rod 27, a push bar 29 disposed on the hollow plate 26, a guide rail 30 having a cover 33 disposed on the frame 20 and a hollow interior 31 receiving a second rack 32, the second rack 32 engaging with the gear 23, and a plurality of fasteners 40 fastening a catch basin 36 on the second rack 32. The cover 33 has a round hole 35. A bearing 34 is inserted in the round hole 35. The catch basin 36 has a plurality of protrusions 361. The first rack 25 has a large number of serrations 251. The second rack 32 has a large number of teeth 321. The cover 33 has a plurality of oblong holes 331.

The hollow main body 2 has a plurality of through holes 15 to be fastened on the platform 11, a guide groove 14, two positioning plates 141 to clamp the adjustment block 16, and an adjustment rod 17 inserted through the hollow main body 2 to block the adjustment block 16. A button 18 is disposed on a lower portion of the adjustment rod 17 in order to move the adjustment block 16 upward and downward.

An end of the push bar 29 is fastened on the mold device 12.

Figure 5:
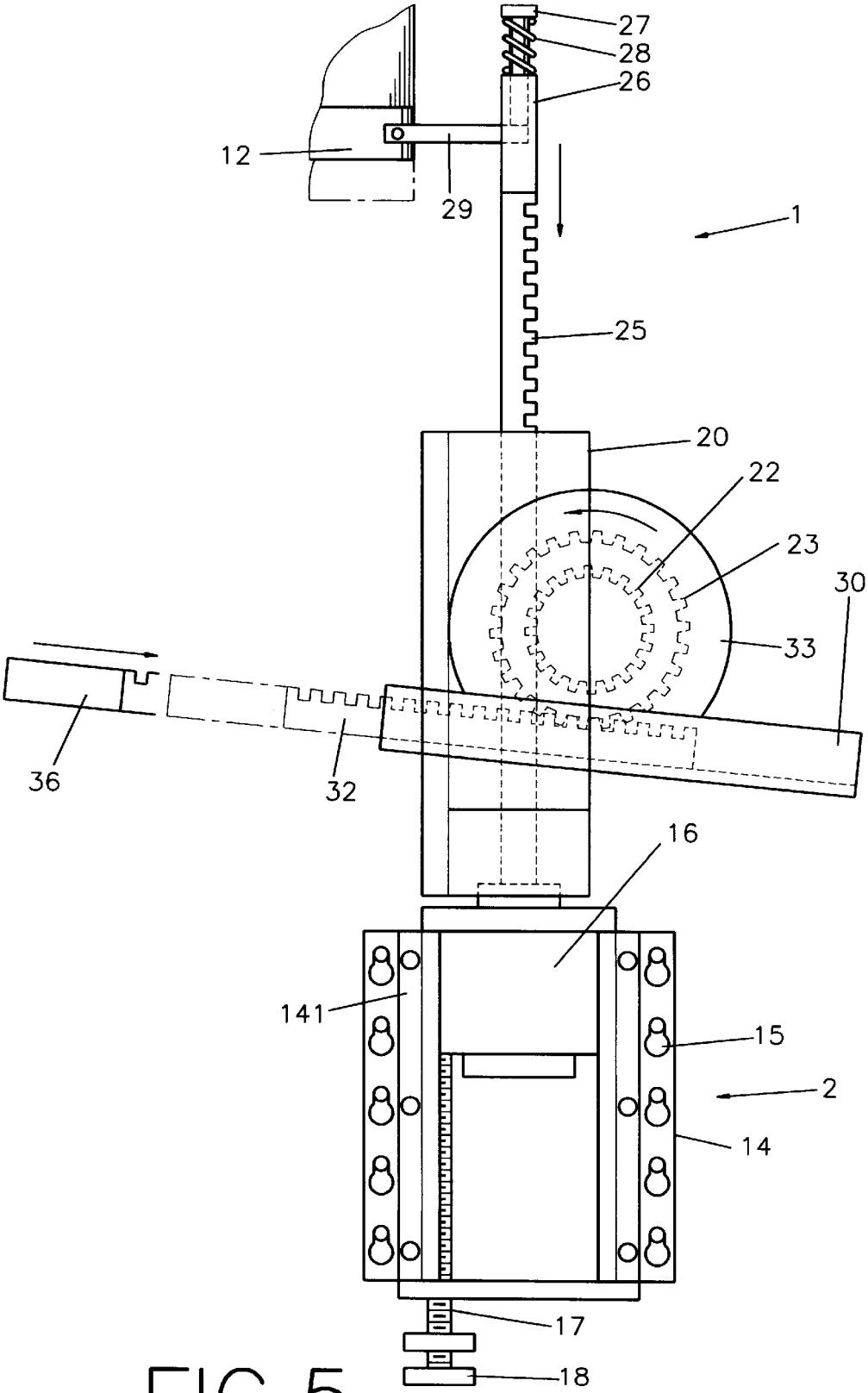
FIG. 5 is a schematic view illustrating another operation of a punch catch device of a preferred embodiment in accordance with this invention.

Referring to FIG. 5, the push bar 29 and the mold device 12 are moved downward. When the first rack 25 moves downward, the pinion 22 and the gear 23 rotate counter-clockwisely. The gear 23 drives the second rack 32 to move rightward.

Figure 4:
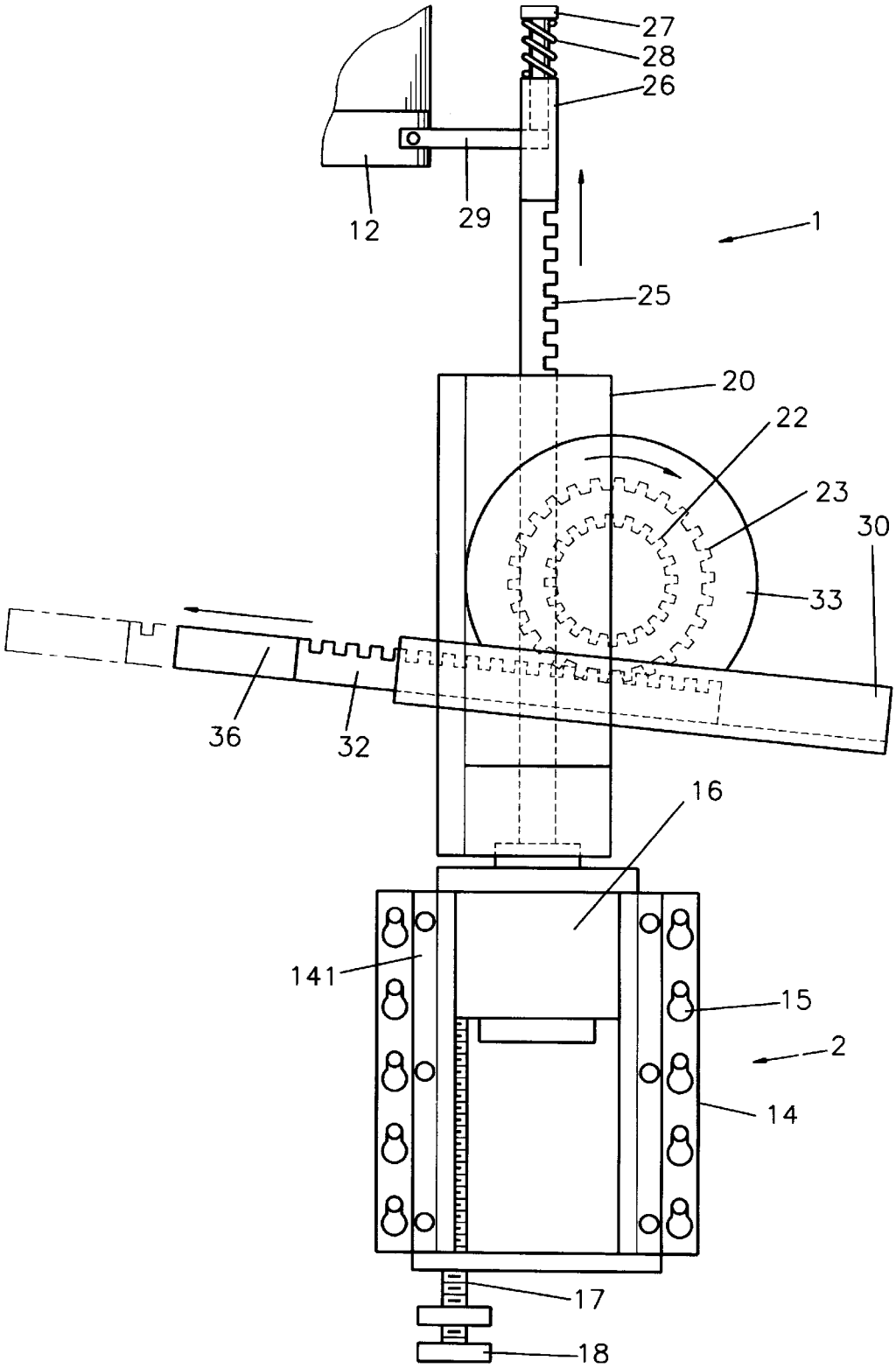
FIG. 4 is a schematic view illustrating an operation of a punch catch device of a preferred embodiment in accordance with this invention.

Referring to FIG. 4, the push bar 29 and the mold device 12 are moved upward. When the first rack 25 moves upward, the pinion 22 and the gear 23 rotate clockwisely. The gear 23 drives the second rack 32 to move leftward. The catch basin 36 can move leftward with the second rack 32 to receive the products and waste materials safely. The products and waste materials are fallen down from the mold device 12 (not shown in the figures).

This invention has the following advantages. The catch basin 36 can move rightward or leftward with the second rack 32. The hollow main body 2 can be hung on the platform 11 via the through holes 15. The adjustment rod 17 can adjust the height of the adjustment block 16. The screw rod 27 can adjust the position of the push bar 29. The cover 33 can adjust the angle of the second rack 32 via the oblong holes 331. The frame 20 can be rotated to a predetermined angle. The guide rail 30 can be rotated to a predetermined angle also.

We claim:

1. A punch catch device comprises:

a hollow main body, an adjustment block disposed in the hollow main body, a center hole formed on the adjustment block, a frame having a post inserted in the center hole, a pinion and a gear disposed in the frame coaxially, a first rack inserted through the frame to engage with the pinion, a hollow plate disposed on the first rack, a screw rod inserted through the hollow plate, a spring enclosing the screw rod, a push bar disposed on the hollow plate, a guide rail having a cover disposed on the frame and a hollow interior receiving a second rack, the second rack engaging with the gear, a plurality of fasteners fastening a catch basin on the second rack, the cover having a round hole, and a bearing inserted in the round hole.

2. A punch catch device as claimed in claim 1, wherein the first rack has a large number of serrations.

3. A punch catch device as claimed in claim 1, wherein the second rack has a large number of teeth.

4. A punch catch device as claimed in claim 1, wherein the cover has a plurality of oblong holes.

5. A punch catch device as claimed in claim 1, wherein the hollow main body has a plurality of through holes, a guide groove, two positioning plates, and an adjustment rod inserted through the hollow main body.

* * * * *